US008565634B2

(12) United States Patent
Nakazato et al.

(10) Patent No.: US 8,565,634 B2
(45) Date of Patent: Oct. 22, 2013

(54) IMAGE FORMING APPARATUS

(75) Inventors: Jun Nakazato, Kashiwa (JP); Hirokazu Kodama, Ryugasaki (JP); Satoru Takezawa, Nagareyama (JP)

(73) Assignee: Canon Kabushiki Kaisha (JP)

( * ) Notice: Subject to any disclaimer, the term of this patent is extended or adjusted under 35 U.S.C. 154(b) by 838 days.

(21) Appl. No.: 11/865,920

(22) Filed: Oct. 2, 2007

(65) Prior Publication Data

US 2008/0089706 A1 Apr. 17, 2008

(30) Foreign Application Priority Data

Oct. 12, 2006 (JP) ..... 2006-278850

(51) Int. Cl.
*G03G 15/00* (2006.01)

(52) U.S. Cl.
USPC ..... 399/72; 399/74; 399/301; 347/116; 430/47.2

(58) Field of Classification Search
USPC ..... 399/44, 301, 72, 74; 347/116; 430/47.2
See application file for complete search history.

(56) References Cited

U.S. PATENT DOCUMENTS

| | | | | |
|---|---|---|---|---|
| 6,148,158 | A * | 11/2000 | Amemiya | 399/39 |
| 6,408,156 | B1 * | 6/2002 | Miyazaki et al. | 399/301 |
| 6,775,489 | B2 * | 8/2004 | Tsuruya et al. | 399/49 |
| 6,847,791 | B2 * | 1/2005 | Kitagawa et al. | 399/49 |
| 6,954,285 | B2 * | 10/2005 | Ogata et al. | 358/1.8 |
| 7,122,800 | B2 * | 10/2006 | Barry et al. | 250/341.1 |
| 7,162,171 | B2 * | 1/2007 | Sugiyama | 399/49 |
| 7,233,749 | B2 * | 6/2007 | Yoshizuka et al. | 399/49 |
| 7,239,833 | B2 * | 7/2007 | Tomita et al. | 399/299 |
| 7,358,983 | B2 * | 4/2008 | Yaji et al. | 347/255 |
| 7,590,364 | B2 * | 9/2009 | Takezawa et al. | 399/49 |
| 7,610,004 | B2 * | 10/2009 | Kato et al. | 399/301 |
| 7,650,094 | B2 * | 1/2010 | Yamamoto et al. | 399/71 |
| 7,664,413 | B2 * | 2/2010 | Kobayashi et al. | 399/49 |
| 7,689,151 | B2 * | 3/2010 | Katsuhara et al. | 399/301 |
| 7,937,032 | B2 * | 5/2011 | Takezawa | 399/301 |
| 7,991,336 | B2 * | 8/2011 | Takezawa et al. | 399/301 |
| 8,145,083 | B2 * | 3/2012 | Carter et al. | 399/49 |
| 8,264,733 | B2 * | 9/2012 | Hanashi et al. | 358/1.18 |
| 8,355,643 | B2 * | 1/2013 | Kojima et al. | 399/49 |
| 8,369,729 | B2 * | 2/2013 | Torimaru | 399/66 |
| 8,385,792 | B2 * | 2/2013 | Miyajima | 399/301 |
| 8,422,895 | B2 * | 4/2013 | Takahashi | 399/49 |
| 2003/0044190 | A1 * | 3/2003 | Nakayama | 399/49 |

(Continued)

FOREIGN PATENT DOCUMENTS

| | | |
|---|---|---|
| JP | 06-127039 A | 5/1994 |
| JP | 08-069146 A | 3/1996 |

(Continued)

*Primary Examiner* — David Gray
*Assistant Examiner* — Geoffrey Evans
(74) *Attorney, Agent, or Firm* — Rossi, Kimms & McDowell LLP

(57) ABSTRACT

An image forming apparatus capable of ensuring a sufficient difference between amounts of light reflected from a base such as a transfer material and from a toner pattern in the detection of the toner pattern for registration correction control by a reflective optical sensor. The image forming apparatus includes a pattern generator for generating a toner pattern, a pattern detection sensor for detecting the toner pattern formed on the intermediate transfer belt, a pattern density decider for determining the density of the toner pattern that makes the amount of light received by the sensor in detection of the toner pattern equal to or less than a predetermined value.

20 Claims, 13 Drawing Sheets

(56) References Cited

U.S. PATENT DOCUMENTS

| | | | | |
|---|---|---|---|---|
| 2003/0049039 | A1* | 3/2003 | Suzuki | 399/49 |
| 2003/0052958 | A1* | 3/2003 | Shinohara | 347/116 |
| 2003/0210412 | A1* | 11/2003 | Ishibashi | 358/1.9 |
| 2005/0046691 | A1* | 3/2005 | Katagiri et al. | 347/221 |
| 2005/0083530 | A1* | 4/2005 | Ogihara et al. | 356/446 |
| 2005/0104950 | A1* | 5/2005 | Eom | 347/116 |
| 2005/0147424 | A1* | 7/2005 | Kato et al. | 399/49 |
| 2005/0281574 | A1* | 12/2005 | Yamamoto et al. | 399/49 |
| 2006/0038873 | A1* | 2/2006 | Hirai et al. | 347/129 |
| 2006/0176355 | A1* | 8/2006 | An | 347/116 |
| 2006/0177246 | A1* | 8/2006 | Kawada et al. | 399/301 |
| 2007/0019976 | A1* | 1/2007 | Watanabe et al. | 399/49 |
| 2007/0025748 | A1* | 2/2007 | Ishibashi et al. | 399/49 |
| 2007/0236553 | A1* | 10/2007 | Kawano et al. | 347/133 |
| 2010/0054774 | A1* | 3/2010 | Yamasaki et al. | 399/49 |
| 2011/0228027 | A1* | 9/2011 | Okada et al. | 347/116 |
| 2012/0045234 | A1* | 2/2012 | Suzuki et al. | 399/49 |
| 2012/0141146 | A1* | 6/2012 | Eom | 399/15 |
| 2012/0155899 | A1* | 6/2012 | Watanabe et al. | 399/49 |
| 2012/0275806 | A1* | 11/2012 | Takezawa | 399/51 |
| 2012/0288289 | A1* | 11/2012 | Kinoshita | 399/39 |
| 2012/0288297 | A1* | 11/2012 | Sugeta et al. | 399/72 |
| 2012/0321331 | A1* | 12/2012 | Shirafuji et al. | 399/49 |
| 2012/0328312 | A1* | 12/2012 | Shoji | 399/49 |
| 2013/0022377 | A1* | 1/2013 | Sugeta et al. | 399/301 |
| 2013/0064560 | A1* | 3/2013 | Hirabayashi | 399/44 |
| 2013/0071131 | A1* | 3/2013 | Hirabayashi | 399/30 |
| 2013/0114965 | A1* | 5/2013 | Kuo et al. | 399/49 |

FOREIGN PATENT DOCUMENTS

| | | | | |
|---|---|---|---|---|
| JP | 2001-222146 | A | | 8/2001 |
| JP | 2003-241470 | A | | 8/2003 |
| JP | 2003-307902 | A | | 10/2003 |
| JP | 2006251686 | A | * | 9/2006 |
| JP | 2010175833 | A | * | 8/2010 |
| JP | 2010181570 | A | * | 8/2010 |

* cited by examiner

IMAGE FORMING APPARATUS

BACKGROUND OF THE INVENTION

1. Field of the Invention

The present invention relates to an image forming apparatus for electrophotographic system-based image formation, such as a printer, copy machine, facsimile, or the like.

2. Description of the Related Art

For registration correction control of an image forming apparatus, a regular reflective optical sensor is generally used, which includes an LED light source (irradiation optical source) and a PD element (light receiving element). The optical sensor is for detecting a toner pattern for registration correction control. The toner pattern is formed on a base such as a sheet or an image carrier, the image carrier being an intermediate transfer belt, a photosensitive drum, or the like. In the detection of a toner pattern by the sensor, amounts of light reflected by the base and by the toner pattern are detected and a difference therebetween is utilized for position detection. Resultant position information is employed, for example, for adjustment of timings of image formation on photosensitive drums of the image forming apparatus for respective colors.

When an intermediate transfer belt or a photosensitive drum is employed as the base, the gloss of a surface of the base is lowered due to long-term use and contamination thereof. When a sheet is employed as the base, the presence of a variety of sheet types (colored paper, glossy paper, or the like) results in a difference in reflectivity between sheet surfaces. In either case, therefore, the amount of light received from the base can vary. To stabilize the received light amount, a technique to correct the amount (intensity) of light irradiated from the optical sensor has been proposed (Japanese Laid-open Patent Publication No. 6-127039).

When applying such technique to the base having an extremely low reflectivity or having a greatly reduced reflectivity due to long-term use, the drive current of an LED light source of the sensor capable of irradiating a large amount of light is increased to an allowable maximum to stabilize the amount of light reflected from the base.

With increase in the amount of light irradiated from the sensor, however, an amount of irregularly reflected light increases in the toner pattern detection, especially, in the detection of a color toner pattern. The irregularly reflected light amount tends to increase as the toner density increases. At the color toner pattern density equal to or higher than a predetermined density, the irregularly reflected light from the toner pattern becomes strong enough to be received by the sensor. In that case, the amount of light received from a surface of the toner pattern increases toward the amount of light received from the base surface, which reduces the difference between the amounts of light reflected from the base and from the toner pattern. As a result, a failure in the toner pattern detection can be caused, resulting in a fear that a defect image is printed out.

In a regular reflective optical sensor, optical axis misalignment occurs due to a mounting error of the sensor to an apparatus, an assembly error of the sensor, a variation in characteristics of optical parts of the sensor, or other reasons. The optical axis misalignment makes the color toner pattern detection more liable to be affected by the irregularly reflected light, resulting in a variation in sensor characteristic of toner density vs. received light amount, so that the received light amount at a predetermined toner pattern density may be varied. Such variation also occurs due to individual differences between apparatuses or between optical sensors.

Moreover, due to a variation in environment around the apparatus, long-term use of the apparatus, and changeover between image processing modes, the toner pattern density shifts from a target density. With the shift in toner pattern density, the amount of irregularly reflected light from the toner pattern surface also varies, resulting in a variation in the amount of light received by the sensor.

If the amount of light received by the sensor in the toner pattern detection changes to increase, a reduction is caused in the difference between the amounts of light received by the sensor from the base and from the toner pattern, making it difficult to discriminate between the base and the toner pattern. This may result in a failure in toner pattern detection, producing a fear that an image entailing an image position displacement is printed out.

SUMMARY OF THE INVENTION

The present invention provides an image forming apparatus capable of ensuring a sufficient difference between amounts of light reflected from a base such as an image carrier or a transfer material and from a toner pattern in the detection of the toner pattern for registration correction control by an optical detection unit.

According to a first aspect of the present invention, there is provided an image forming apparatus comprising a pattern generating unit adapted to generate a toner pattern for registration correction control, an optical detection unit adapted to detect the toner pattern formed on an image carrier or a transfer material, and a pattern density decision unit adapted to determine a density of the toner pattern that makes an amount of light received by the optical detection unit in detection of the toner pattern equal to or less than a predetermined value.

According to a second aspect of the present invention, there is provided an image forming apparatus comprising a pattern generating unit adapted to generate a toner pattern for registration correction control, an optical detection unit adapted to detect the toner pattern formed on an image carrier or a transfer material, and a pattern density adjustment unit adapted to calculate a density of the toner pattern that minimizes an amount of light received by the optical detection unit in detection of a plurality of the toner patterns formed to have different densities on the image carrier or the transfer material.

According to a third aspect of the present invention, there is provided an image forming apparatus comprising a pattern generating unit adapted to generate a toner pattern for registration correction control, an optical detection unit adapted to detect the toner pattern formed on an image carrier or a transfer material, and a pattern density control unit adapted to change a target density of a toner pattern to be formed on the image carrier or the transfer material in next registration correction control in accordance with an amount of light received by the optical detection unit in detection of the toner pattern formed on the image carrier or the transfer material.

According to the present invention, in the detection of a toner pattern for registration correction control by the optical detection unit, it is possible to ensure a sufficient difference between amounts of light reflected from a base such as an image carrier or a transfer material and from the toner pattern.

Further features of the present invention will become apparent from the following description of exemplary embodiments with reference to the attached drawings.

DETAILED DESCRIPTION OF THE PREFERRED EMBODIMENTS

The present invention will now be described in detail below with reference to the drawings showing preferred embodiments thereof.

First, with reference to FIGS. 1 to 6, an image forming apparatus according to a first embodiment of the present invention will be explained.

Figure 1:
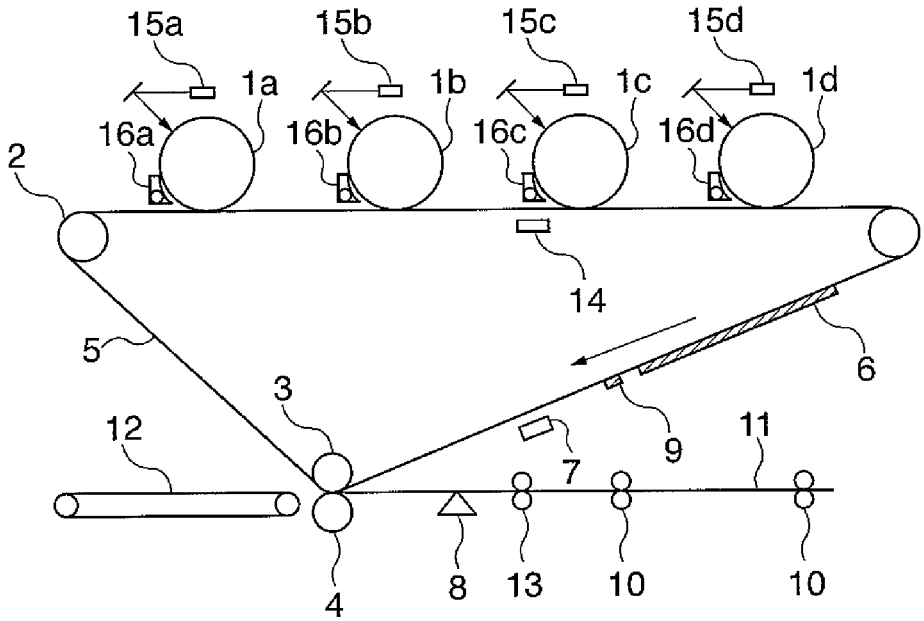
FIG. 1 is a schematic view for explaining the construction of an image forming section of an image forming apparatus according to a first embodiment of the present invention.
Figure 2:
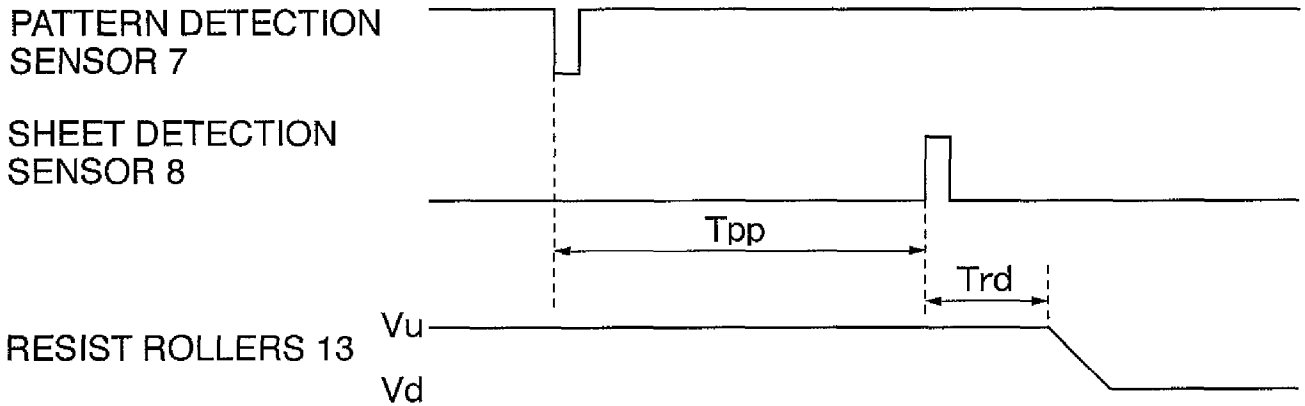
FIG. 2 is a timing chart for explaining basic image-position correction control performed by the image forming apparatus shown in FIG. 1.
Figure 3:
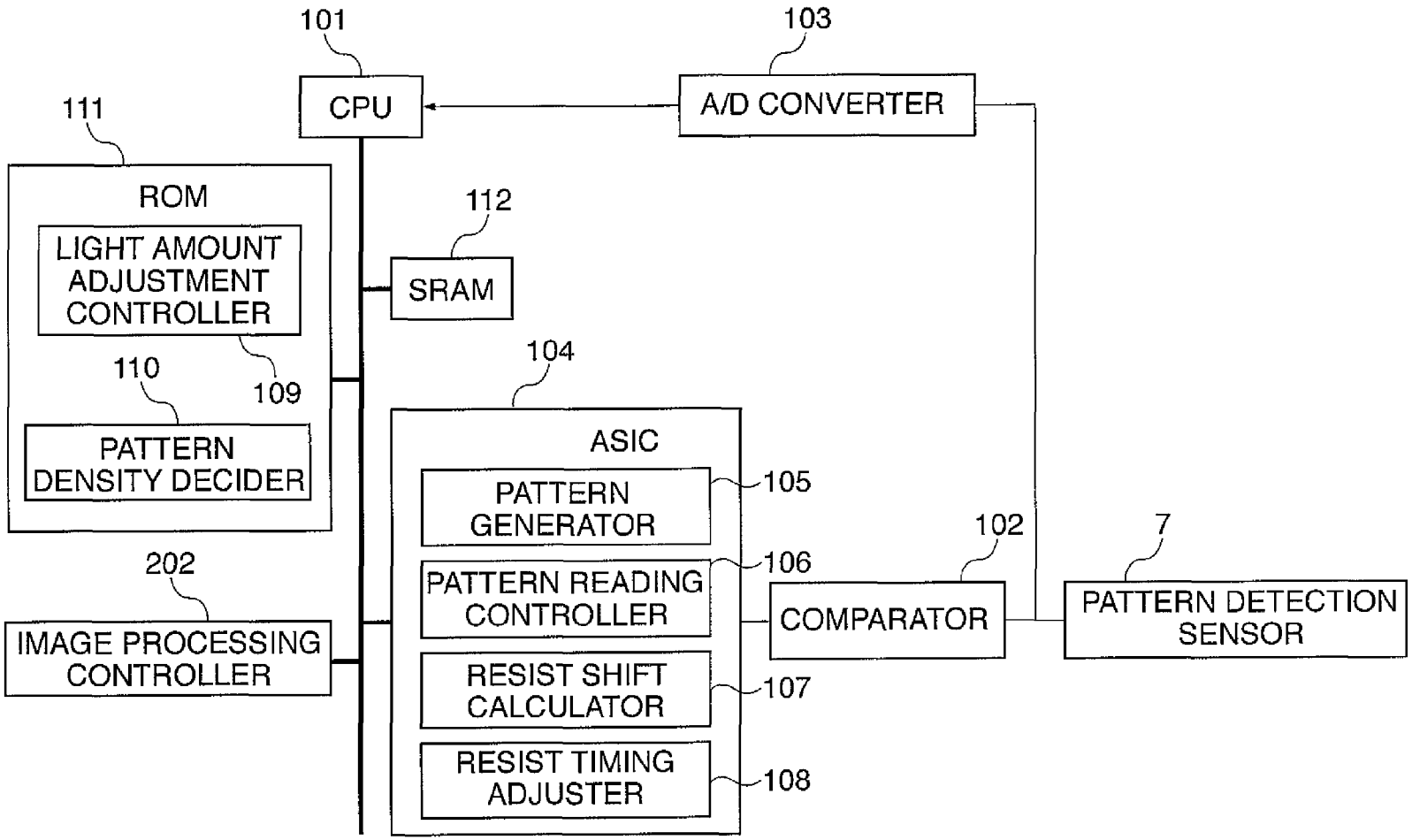
FIG. 3 is a block diagram schematically showing a control circuit for implementing the image-position correction control.
Figure 4:
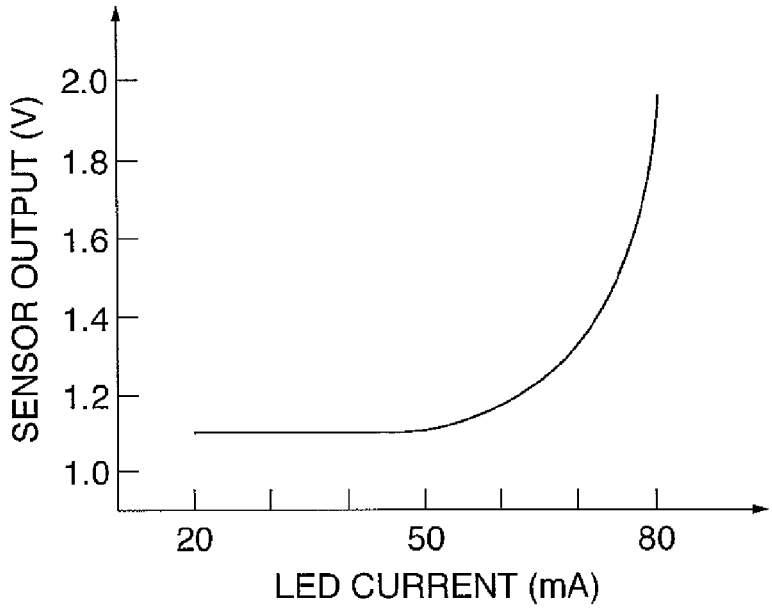
FIG. 4 is a graph showing a relation between amounts of light irradiated from and received by a pattern detection sensor at a maximum toner pattern density.
Figure 5:
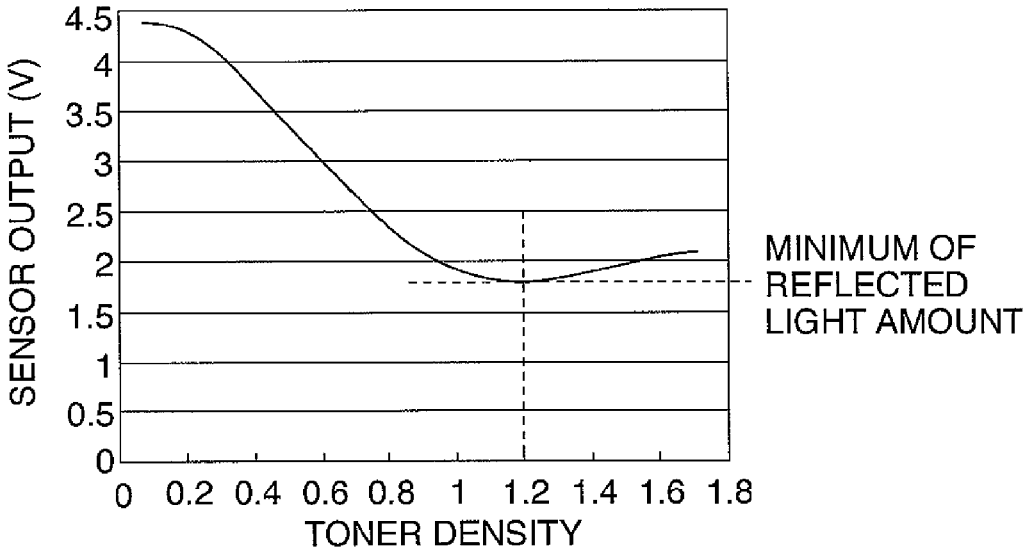
FIG. 5 is a graph showing a relation between the toner pattern density and the amount of light received by the pattern detection sensor, the relation being observed when the amount of light irradiated from an LED light source is at a maximum.
Figure 6:
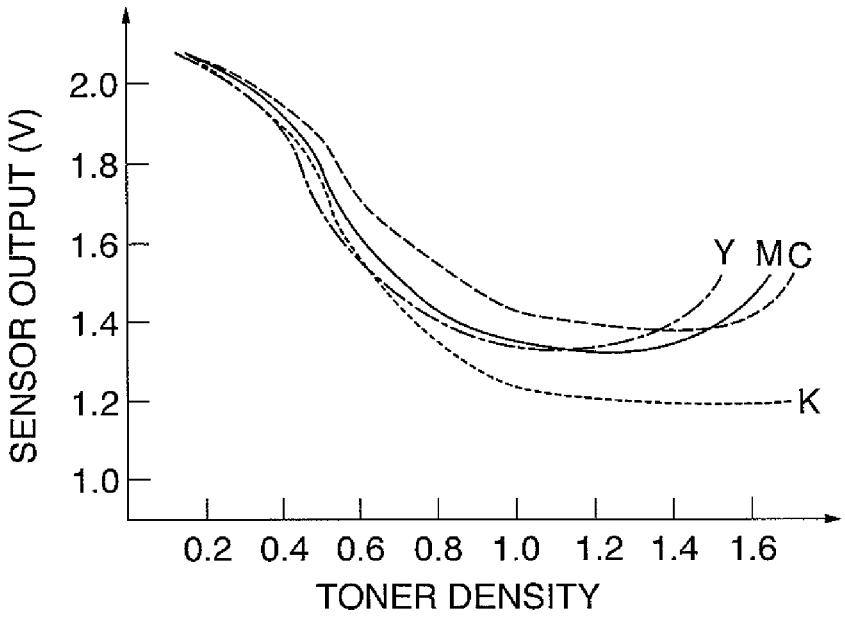
FIG. 6 is a graph showing a relation for each color between the toner pattern density and the received light amount, the relation being observed when the amount of light irradiated from the LED light source is at a maximum and the pattern detection sensor is employed as a color shift detection sensor.

FIG. 1 is a schematic view for explaining the construction of an image forming section of an image forming apparatus according to the first embodiment, and FIG. 2 is a timing chart for explaining basic image-position correction control performed by the image forming apparatus shown in FIG. 1. FIG. 3 is a block diagram schematically showing a control circuit for implementing the image-position correction control, and FIG. 4 is a graph showing a relation between amounts of light irradiated from and received by a pattern detection sensor at a maximum toner pattern density. FIG. 5 is a graph showing a relation between the toner pattern density and the amount of light received by the pattern detection sensor, the relation being observed when the amount of light irradiated from an LED light source is at a maximum. FIG. 6 is a graph showing a relation for each color between the toner pattern density and the received light amount, the relation being observed when the amount of light irradiated from the LED light source is at a maximum and the pattern detection sensor is employed as a color shift detection sensor.

As shown in FIG. 1, the image forming section of the image forming apparatus according to the first embodiment includes laser write units 15*a* to 15*d* disposed in the order of yellow (Ye), cyan (Cy), magenta (Ma), black (Bk). Latent images are formed on photosensitive drums 1*a* to 1*d* by the laser write units 15*a* to 15*d* and developed by development units 16*a* to 16*d*, whereby toner images of respective colors are formed on the photosensitive drums. The toner mages formed on the photosensitive drums 1*a* to 1*d* are sequentially transferred to and superposed one upon another on an intermediate transfer belt (an image carrier) 5, whereby a color toner image 6 is formed on the intermediate transfer belt 5. For registration correction control, an image-position correction pattern (toner pattern) 9 is transferred to and formed on the intermediate transfer belt 5, as with the color toner image 6, in a position forward of the color toner image 6.

At a junction between the belt supporting roller 3 and the transfer roller 4 (transfer position), the color toner image 6 is transferred from the intermediate transfer belt 5 onto a sheet. The sheet on which the color toner image is to be transferred is conveyed to resist rollers 13 from a sheet receiving section (not shown) along a conveying path 11 by means of conveying rollers 10. The sheet conveying velocity by the resist rollers 13 is adjusted in accordance with a detection timing of the sheet by the sheet detection sensor 8, whereby the color toner image 6 is transferred onto a predetermined position on the sheet. The sheet on which the color toner image 6 has been transferred is conveyed to a fixing section (not shown) by means of the transfer belt 12, whereby the unfixed toner image is fixed onto the sheet, which is discharged to the outside of the apparatus.

The image-position correction pattern 9 is for indirectly detecting the position of the color toner image 6 on the intermediate transfer belt 5 using a pattern detection sensor (optical detection unit) 7. As the pattern detection sensor 7, a reflective optical sensor is employed, which is for receiving light reflected by the intermediate transfer belt 5. In addition to a toner pattern image formed on the intermediate transfer belt 5, flaw and dust on the belt surface can be detected by the sensor.

Next, with reference to FIG. 2, an explanation will be given of image-position (registration) correction control performed for ensuring accurate transfer of a color toner image 6 onto a sheet.

This image-position correction control adjusts the sheet conveyance velocity by the resist rollers 13 in accordance with detection timings of an image-position correction pattern 9 by the pattern detection sensor 7 and of a sheet by the sheet detection sensor 8.

More specifically, there is measured a time Tpp from when the image-position correction pattern 9 on the intermediate transfer belt 5 conveyed at a velocity of Vu is detected by the pattern detection sensor 7 to when the sheet conveyed by the resist rollers 13 at a velocity of Vu is detected by the sheet detection sensor 8. After the Tpp measurement, a time Trd representing a deceleration timing of the resist rollers 13 is calculated.

Here, formula of $Trd=Tpp-T$ is satisfied, where T is a constant that is determined by distances between the pattern detection sensor 7 and the transfer position, between the sheet detection sensor 8 and the transfer position, and between the image-position correction pattern 9 and the color toner image 6 as well as the velocity Vu ($Vu>Vd$). By controlling the sheet conveyance velocity by the resist rollers 13 from Vu to Vd upon elapse of time Trd from when the sheet was detected by the sheet detection sensor 8, it is possible to transfer the color toner image 6 onto the desired position on the sheet. The velocity control is terminated before the sheet reaches the transfer position. Subsequently, the color toner image 6 whose position on the sheet has been adjusted is transferred onto the sheet, which is then conveyed to the fixing unit and discharged therefrom.

Next, with reference to FIG. 3, the schematic construction of a control circuit for carrying out image-position correction control will be described.

As described above, the pattern detection sensor 7 is a reflective optical sensor for detecting a toner pattern 9 formed on the intermediate transfer belt 5. The pattern detection sensor 7 converts amounts of light reflected by the surface of the intermediate transfer belt 5 and by the image-position correction pattern 9 formed on the surface of the intermediate transfer belt 5 into a voltage for output. The voltage converted from the reflected light amount is supplied to the comparator 102 and the A/D converter 103.

The comparator 102 determines whether or not the output voltage signal supplied from the pattern detection sensor 7 is greater than a predetermined threshold value, and outputs the resultant binarized digital signal to the ASIC 104. The A/D converter 103 converts the analogue output signal supplied from the pattern detection sensor 7 into a digital signal for output to the CPU 101.

The ASIC 104, which is comprised of a digital integrated circuit, includes a pattern generator (pattern generating unit) 105, a pattern reading controller 106, a resist shift calculator 107, and a resist timing adjuster 108.

The pattern generator 105 generates image data of an image-position correction pattern 9 for use in registration correction control. The pattern reading controller 106 reads the binarized output signal from the pattern detection sensor 7 and temporarily stores the read output signal (pattern data). The resist shift calculator 107 calculates a timing deviation between the sheet and the toner color image 6 based on the pattern data read by the pattern reading controller 106. Based on the timing deviation calculated by the resist shift calculator 107, the resist timing adjuster 108 controls the timing of sheet conveyance.

The CPU 101 is an essential part of the control system and provides various instructions including timing of execution of registration correction control. The CPU 101 carries out control based on program data stored in the ROM 111. The program data includes data for use by the light amount adjustment controller 109 for adjusting the amount of light irradiated from the pattern detection sensor 7 in the registration correction control and data for use by a pattern density decider (pattern density decision unit) 110 by which the present invention is characterized.

The SRAM 112 is stored with data, which is unique to the apparatus, such as a value of LED drive current for the pattern detection sensor 7 determined by the light amount adjustment controller 109. The image processing controller 202 carries out various image processing control, such as halftone density adjustment, in accordance with instructions supplied from the CPU 101.

In the following, an explanation will be given of the pattern density decider 110 by which the present invention is characterized. The program data includes a target density value used for forming the image-position correction pattern 9, which is derived in advance in accordance with knowledge of the present inventors et al. The density target value is determined such as to make the pattern detection voltage equal to or less than a predetermined value, without regard to the amount of light irradiated from the LED light source of the pattern detection sensor 7.

The image forming apparatus of this embodiment is configured to ensure its mechanical design accuracy in reference to a magenta image forming section, and therefore, an image-position correction pattern 9 of magenta color, which is a reference color, is formed for the registration correction control. The sheet conveyance control is carried out in timing synchronous with the position of the magenta image-position correction pattern 9 detected by the pattern detection sensor 7. The pattern density decider 110 is stored with a density value for the magenta image-position correction pattern 9.

FIG. 4 is a view showing a relation between amounts of light irradiated from the LED light source of the pattern detection sensor 7 and received by the sensor 7, the relation being observed when a toner pattern of a maximum density is detected by the pattern detection sensor 7.

As apparent from FIG. 4, with increase in the irradiated light amount by increasing the drive current for the LED light source of the pattern detection sensor 7, the sensor output starts to increase at the drive current of about 50 mA or more. It is considered that this is because when the amount of irradiated light reaches a certain level, the amount of irregularly reflected light from the toner surface increases to a level large enough to be received by the sensor 7.

In the detection of a denser toner image, with increase in the amount of light irradiated from the LED light source, the amount of light received by the sensor 7 becomes more unstable, thereby changing the amount of light received from the toner image by the sensor 7 toward the received light amount in the detection of the intermediate transfer belt 5 (the base). The tendency of decrease of the difference between the levels of light received from the intermediate transfer belt 5 and from the toner pattern can cause a failure in the toner pattern detection.

FIG. 5 is a view showing a relation between the amount of light received by the sensor and the toner density in the magenta toner pattern detection at a maximum drive current of the LED light source of the pattern detection sensor 7. It is understood from FIG. 4 that the maximum variation in the received light amount in the toner surface detection mostly occurs when the amount of light irradiated from the sensor is at a maximum. The present inventor et al. determined a toner density that minimizes the amount of light received by the sensor at a maximum irradiated light amount. As understood from FIG. 5, the received light amount becomes a minimum at a toner pattern density value of 1.2. In FIG. 5, the toner pattern density becomes larger with increase of the abscissa value.

Based on the teaching shown in FIG. 5, a target density of the toner pattern to be set in the pattern density decider 110 is derived. In this embodiment, the target density of magenta image-position correction pattern 9 has a value of 1.2.

In this embodiment, the pattern detection sensor 7 for controlling the position of an image on a sheet has been described. However, the pattern detection sensor 7 can also be used as a color-shift detection sensor for detecting color shift in four colors. In that case, toner pattern density values derived for respective colors are set into the pattern density decider 110, thereby absorbing differences in light reflection characteristic between the colors.

FIG. 6 is a view showing a relation between the density of a toner pattern for color-shift detection and the reflected light amount, the relation being observed when the toner pattern is detected by a color-shift detection sensor (not shown) disposed to face the intermediate transfer belt 5, as with the pattern detection sensor 7. If the reflection characteristic is different between respective colors as shown in FIG. 6, a density value which minimizes the reflected light amount is also different between the colors. It is effective to set a toner pattern density value for each color into the pattern density decider 110, as described above.

When the toner pattern is formed not at a maximum density but at an intermediate density, the desired density value varies between image processing modes. In that case, the toner pattern density can be stabilized in any of the image processing modes, by independently setting toner pattern density values for the respective image processing modes into the pattern density decider 110.

As described above, in this embodiment, the image-position correction pattern 9 for registration correction control for being detected by the pattern detection sensor 7, which is a regular reflective optical sensor, has a density value that minimizes the amount of light received by the sensor. This stably ensures a sufficient difference between the amounts of light reflected from the intermediate transfer belt 5 (the base) and from the image-position correction pattern 9, even if the irradiated light amount becomes higher as a result of a light amount adjustment of the LED light source of the pattern detection sensor 7 or as a result of a variation in light amount. This makes it possible to prevent a failure in the detection of image-position correction pattern 9, whereby an image with an image position deviation can be prevented from being printed out.

Next, with reference to FIGS. 7 to 10, an image forming apparatus according to a second embodiment of the present invention will be explained.

Figure 7:
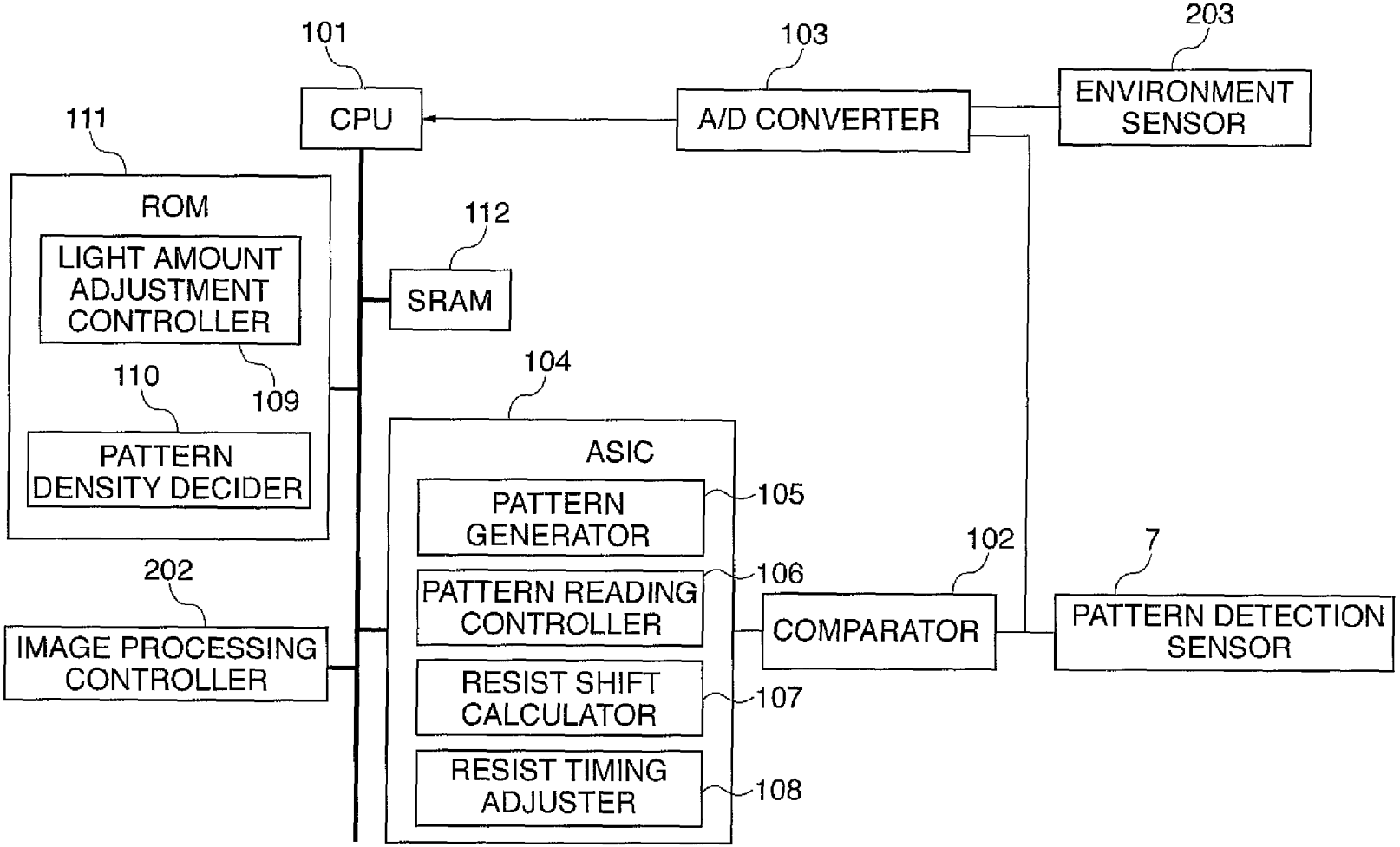
FIG. 7 is a block diagram for schematically showing a control circuit of an image forming apparatus according to a second embodiment of the present invention for implementing registration correction control.
Figure 8:
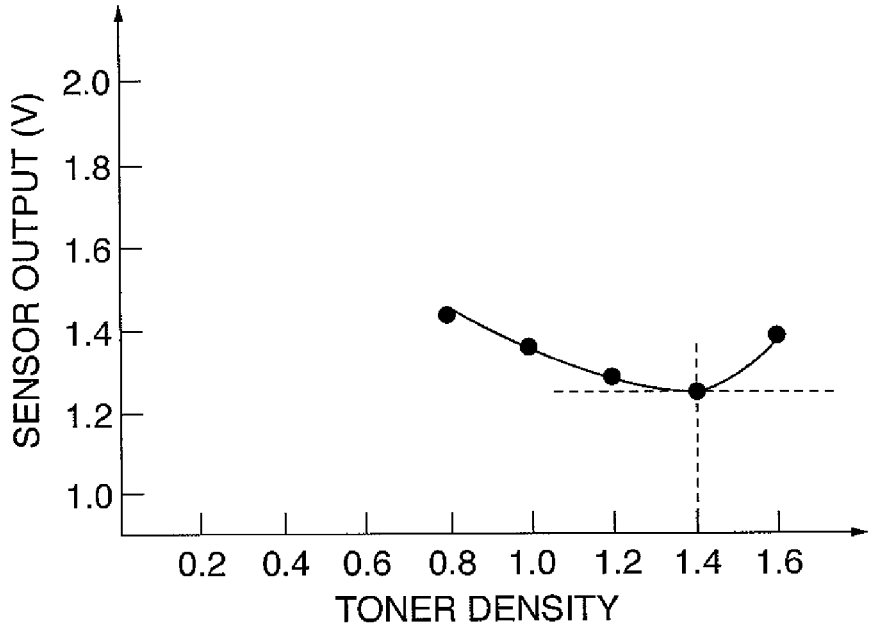
FIG. 8 is a graph showing a change in received light amount when toner patterns with five different density levels are detected by a pattern detection sensor.
Figure 9:
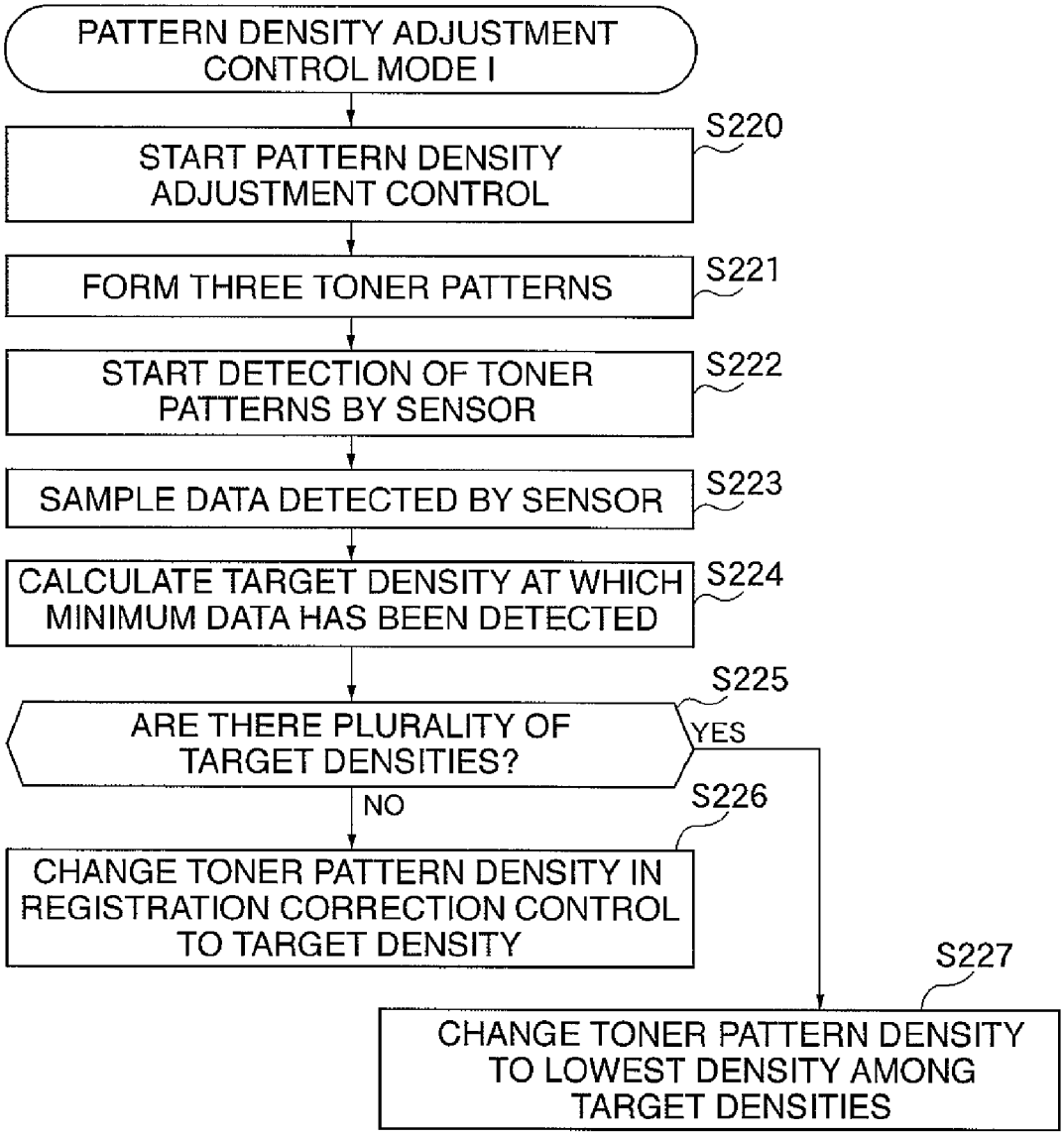
FIG. 9 is a flowchart for explaining an exemplar operation in pattern density adjustment control mode I.
Figure 10:
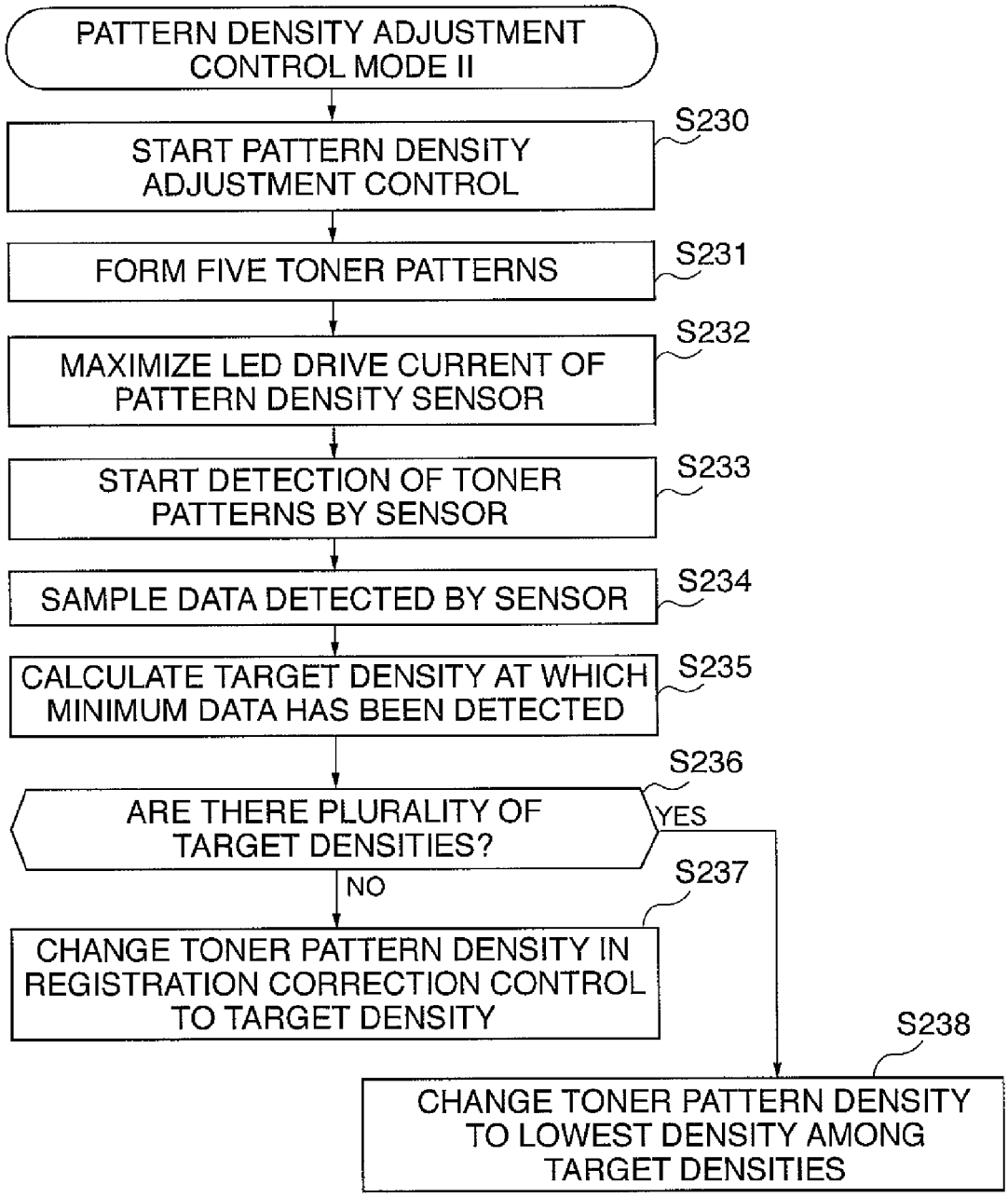
FIG. 10 is a flowchart for explaining an exemplar operation in pattern density adjustment control mode II.

FIG. 7 is a block diagram for schematically showing a control circuit of the image forming apparatus of the second embodiment for implementing registration correction control. FIG. 8 is a graph showing a change in received light amount in the detection of toner patterns with five different density levels by the pattern detection sensor. FIG. 9 is a flowchart for explaining an exemplar operation in pattern density adjustment control mode I, and FIG. 10 is a flowchart for explaining an exemplar operation in pattern density adjustment control mode II. It should be noted that the image forming section of the image forming apparatus is the same as that of the first embodiment having been described with reference to FIG. 1, and therefore, explanations thereof will be omitted. The basic control for image-position (registration) correction is the same as that of the first embodiment having been described with reference to FIG. 2, and therefore, explanations thereof will be omitted. The same or similar parts to those of the first embodiment are designated by the same numerals.

First, with reference to FIG. 7, the schematic construction of a control circuit that carries out the image-position (registration) correction control will be described.

A pattern detection sensor (optical detection unit) 7 is a reflective optical sensor for detecting an image-position correction pattern 9 formed on the intermediate transfer belt 5. The pattern detection sensor 7 converts amounts of light reflected from a surface of the intermediate transfer belt 5 and from the image-position correction pattern 9 formed on the surface of the intermediate transfer belt 5 into a voltage for output. The voltage from the pattern detection sensor 7 indicating the received light amount is supplied to a comparator 102 and an A/D converter 103.

The comparator 102 determines whether or not the output voltage signal supplied from the pattern detection sensor 7 is greater than a predetermined threshold value, and outputs the resultant binarized digital signal to an ASIC 104. The A/D converter 103 converts the analog output signal supplied from the pattern detection sensor 7 into a digital signal for output to the CPU 101.

The ASIC 104, which is comprised of a digital integrated circuit, includes a pattern generator (pattern generating unit) 105, a pattern reading controller 106, a resist shift calculator 107, and a resist timing adjuster 108.

The pattern generator 105 generates image data of an image-position correction pattern 9 for use in registration correction control. The pattern reading controller 106 reads the binarized output signal from the pattern detection sensor 7 and temporarily stores the read pattern data. Based on the pattern data read by the pattern reading controller 106, the resist shift calculator 107 calculates a timing deviation between a sheet and a color toner image 6. The resist timing adjuster 108 controls the sheet conveyance timing based on the timing deviation calculated by the resist shift calculator 107.

The CPU 101 is an essential part of the control system and controls various instructions including the timing of execution of the registration correction control. The CPU 101 carries out control based on program data stored in the ROM 111. The program data includes data for use by the light amount adjustment controller 109 for adjusting the amount of light irradiated from the pattern detection sensor 7 in the registration correction control and data for use by a pattern density adjustment controller (pattern density adjustment unit) 201 by which the present invention is characterized.

The SRAM 112 is stored with data, which is unique to the apparatus, such as a value of LED drive current for the pattern detection sensor 7 determined by the light amount adjustment controller 109. The image processing controller 202 carries out various image processing control, such as halftone density adjustment, in accordance with instructions supplied from the CPU 101. Furthermore, the apparatus is provided with an environment sensor 203 for detecting temperature and humidity. An output of the environment sensor 203 is converted into a digital signal by the A/D converter 103 and supplied to the CPU 101.

In the following, an explanation will be given of the pattern density adjustment controller 201 by which the present invention is characterized. The pattern density adjustment controller 201 is stored with program data for use in adjusting, to an optimum value, the density of the image-position correction pattern 9 to be formed on the intermediate transfer belt 5 for registration correction control.

Specifically, the pattern density adjustment controller 201 is stored with control programs for use in continuously forming a plurality of toner patterns with different densities on the intermediate transfer belt 5. The pattern density adjustment controller 201 is further stored with control programs for use in calculating, based on a result of detection of the toner patterns with different densities by the pattern detection sensor 7, a target density value that minimizes the received light level in the toner pattern detection. In addition, the pattern density adjustment controller 201 is stored with a control program for setting the calculated target density value as a density value of the image-position correction pattern 9 to be formed on the intermediate transfer belt 5 in the registration correction control.

FIG. 8 is a view showing received light amounts observed when toner patterns having five different target density values with 0.2 interval are detected by the pattern detection sensor 7.

The five target densities are determined to have their central value (here, 1.2) coincident with the density of the image-position correction pattern 9 formed on the intermediate transfer belt 5 in the immediately preceding registration correction control. If a result of the detection on the toner pattern is as shown in FIG. 8, a target density value of 1.4 that minimizes the amount of reflected light is derived. The derived value of 1.4 is set as the target density of the image-position correction pattern 9 to be formed on the intermediate transfer belt 5 in the next registration correction control.

Next, with reference to FIG. 9, an exemplar operation in the pattern density adjustment control mode I will be described.

The pattern density adjustment control is started at the desired timing (step S220), and three toner patterns having different target density values of from 1.0 to 1.4 with 0.2 interval are continuously formed on the intermediate transfer belt 5 (step S221).

Next, the toner patterns formed in the step S221 are detected by the pattern detection sensor 7 (step S222). The amount of light irradiated from the LED light source of the pattern detection sensor 7 in the toner pattern detection is made equal to that in the registration correction control. A detection signal from the pattern detection sensor 7 is converted into digital by the A/D converter 103 for output to the CPU 101. The CPU 101 samples the sensor detection signal in timings corresponding to six points on each toner pattern. Among the six pieces of sampled data on each toner pattern, maximum and minimum data are removed, and an average value of the remaining sampled data is calculated to detect data indicating the amount of light reflected from each toner pattern (step S223).

Next, among the three pieces of detected data on the three toner patterns, one or more pieces of minimum data are determined, and one or more target densities at each of which the minimum data has been detected are derived (step S224). A target density value of 1.4 is detected as the minimum data, if a relation between the received light amount and the toner density in the example explained here is the same as or similar to that shown in FIG. 8 although the number of the toner patters (toner densities) in FIG. 8 is not three but five, unlike in this example. If it is determined that only one piece of minimum data has been derived (No to the step S225), then a corresponding target density value is set as the density of the image-position correction pattern 9 to be formed on the intermediate transfer belt 5 in the next and subsequent registration correction control (step S226).

On the other hand, if it is determined in the step S225 that a plurality of pieces of the same minimum data have been derived (Yes to the step S225), the process proceeds to a step S227. In the step S227, the lowest density among the target densities respectively corresponding to the pieces of the minimum data is set as the density of the image-position correction pattern 9 to be formed on the intermediate transfer belt 5 in the next and subsequent registration correction control. By selecting the lowest toner density in the step S227, wasteful toner consumption can be suppressed.

By performing the pattern density adjustment control mode I, the amount of light received by the sensor can stably be maintained in the detection of the image-position correction pattern 9 for the registration correction control.

Next, with reference to FIG. 10, an explanation will be given of an exemplar operation in pattern density adjustment control mode II.

The pattern density adjustment control is started in the desired timing (step S230), and five toner patterns having different target density values of from 0.8 to 1.6 with 0.2 interval are continuously formed on the intermediate transfer belt 5 (step S231).

Next, in a step S232, the drive current value for the LED light source of the pattern detection sensor 7 is made maximum, and the toner patterns formed in the step S231 are detected by the pattern detection sensor 7 (step S233) A detection signal from the pattern detection sensor 7 is converted into digital by the A/D converter 103 and supplied to the CPU 101. The CPU 101 samples the sensor detection signal in timings corresponding to six points on each toner pattern. Among the six pieces of sampled data on each toner pattern, maximum and minimum data are removed, and an average value of the remaining sampled data is calculated to detect data indicating the amount of light reflected from each toner pattern (step S234).

Then, among the five pieces of detected data on the five toner patterns, one or more pieces of minimum data are determined, and one or more target densities at each of which the minimum data has been detected are derived (step S235). If it is determined that only one piece of minimum data has been derived (No to the step S236), a target density value corresponding thereto is set as the density of the image-position correction pattern 9 to be formed on the intermediate transfer belt 5 in the next and subsequent registration correction control (step S237).

On the other hand, if it is determined in the step S236 that a plurality of pieces of the same minimum data have been derived (Yes to the step S236), the process proceeds to a step S238. In the step S238, the lowest target density among target densities respectively corresponding to the pieces of minimum data is set as the density of the image-position correction pattern 9 to be formed on the intermediate transfer belt 5 in the next and subsequent registration correction control. By selecting the lowest toner density in the step S238, wasteful toner consumption can be suppressed.

In the mode I, the amount of light irradiated from the LED light source of the pattern detection sensor 7 in the detection of the three toner patterns is made equal to the amount of irradiated light in the registration correction control. On the other hand, in the mode II, the drive current of the LED light source is controlled to a maximum in the range of use. In the mode II where the amount of light irradiated from the LED light source of the pattern detection sensor 7 is maximized, the sensor 7 has its characteristic likely to be mostly affected by light reflected from the toner pattern surface. By adjusting the target density of the toner pattern to have the optimum value in such a condition, it is possible to suppress a variation in the received light amount in the toner pattern detection for registration correction control, irrespective of whatever amount of light has been set as a result of light amount adjustment for the pattern detection sensor 7. Thus, the pattern density adjustment control does not impair the accuracy of target density, even if the pattern density adjustment control is executed in timing asynchronous with the light amount adjustment control. However, the toner surface detection characteristic becomes sensitive in the mode II. In order to realize the optimum target density detection, it is preferable that the number of toner pattern gradations be increased in order to finely detect the sensor outputs (received light amounts) used for the target density determination, as described in connection with the step S231.

On the other hand, in the mode I, the pattern density is adjusted under the same amount of irradiated light as that in the actual registration correction control. Irradiation of light whose amount is not particularly large results in small differences between amounts of light received from the toner patterns. Thus, using toner patterns with a smaller number of gradations, sensor outputs (received light amounts) for the target density determination can roughly be detected. Furthermore, the pattern density adjustment control implemented in the same condition as that in the actual registration correction control reduces an error in the amount of light received by the sensor in the toner pattern detection. It is preferable that the pattern density adjustment control in the mode I be performed in timing synchronous with light amount adjustment. For example, the pattern density adjustment control should be performed in succession to the light amount adjustment control.

The selection in which one of the modes I and II the pattern density adjustment control should be performed may be made in accordance with the product specification and the apparatus construction.

As for the timings in which the pattern density adjustment control is performed, it is advisable to perform the pattern density adjustment control immediately after changeover between image processing modes, whereby a difference in the toner pattern density between image processing modes can be absorbed. By performing the pattern density adjustment each time a predetermined time period elapses after power supply switched on or each time a predetermined number of prints have been printed, the amount of light received by the sensor in the toner pattern detection can be kept stable, even if the toner pattern density varies due to long-term use of the apparatus. Furthermore, by performing the pattern density adjustment when the environment sensor 203 detects a change in environmental condition, it is possible to absorb a change in toner pattern density caused by an abrupt environmental change.

As explained above, in this embodiment, a plurality of toner patterns with different toner densities are formed on the intermediate transfer belt 5, and a toner pattern density is calculated that minimizes the amount of light received by the pattern detection sensor 7 in the toner pattern detection. Then, the calculated toner pattern density is set as the density of the image-position correction pattern 9 to be formed on the intermediate transfer belt 5 in the next and subsequent registration correction control.

Accordingly, it is possible to suppress the amount of light received by the sensor in the toner pattern detection from being varied due to a deviation in the sensor's light receiving characteristic caused by an optical axis deviation, which is in turn caused by optical individual differences between pattern detection sensors 7 and an error in mounting the pattern detection sensor 7 to the apparatus. Furthermore, it is possible to suppress the amount of light received by the sensor from being varied due to a variation in toner density caused by environmental variation, long-term use, and changeover between image processing modes.

As a result, a sufficient difference between the amounts of light reflected by the intermediate transfer belt 5 forming the base and by the image-position correction pattern 9 can stably be ensured to thereby prevent a failure in detecting the image-position correction pattern 9 and prevent an image with image position deviation from being printed out.

In the following, with reference to FIGS. 11 to 14, an image forming apparatus according to a third embodiment of the present invention will be described.

Figure 11:
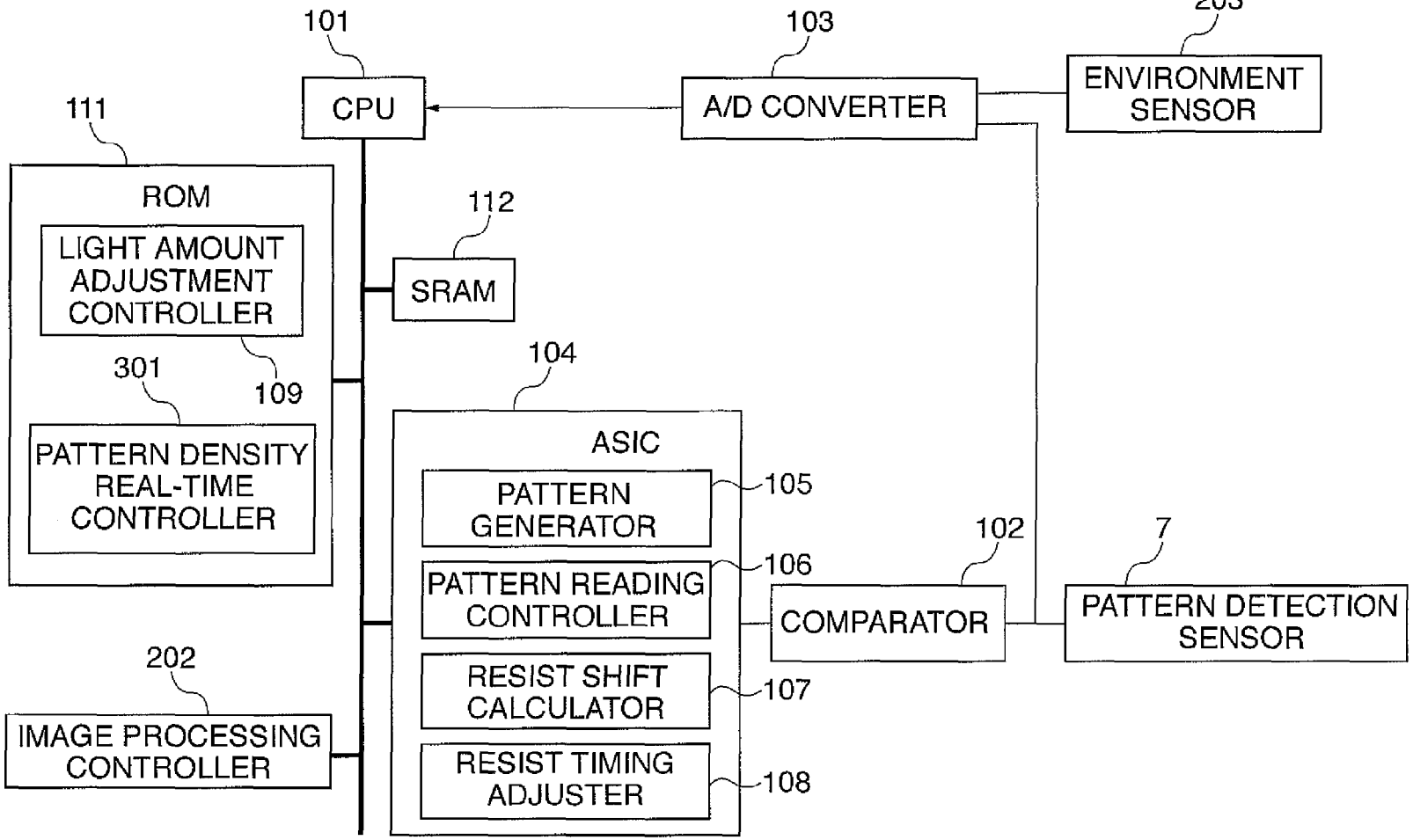
FIG. 11 is a block diagram for schematically showing a control circuit of an image forming apparatus according to a third embodiment of the present invention for implementing registration correction control.
Figure 12:
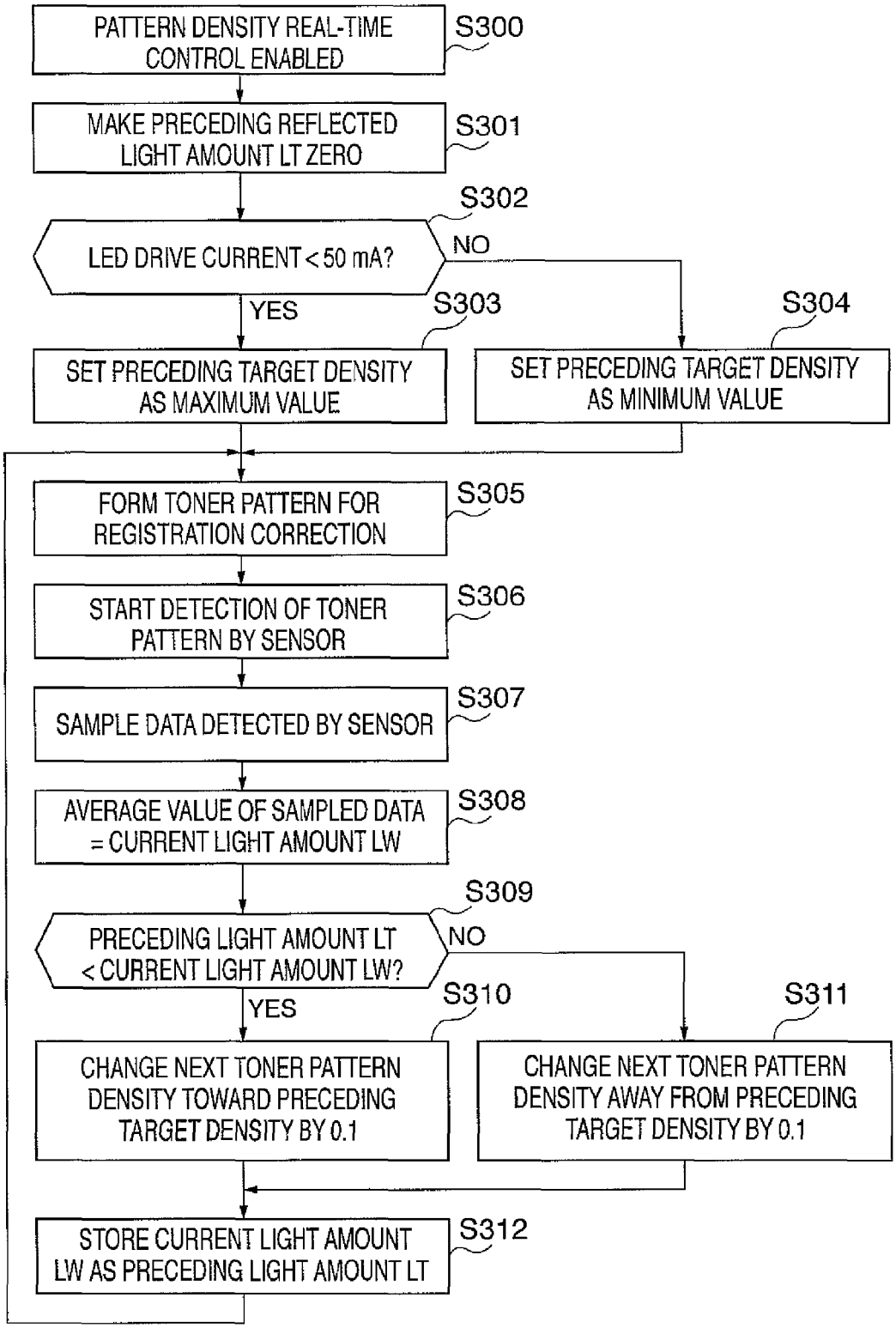
FIG. 12 is a flowchart for explaining an exemplar operation in pattern density real-time control mode I.
Figure 13:
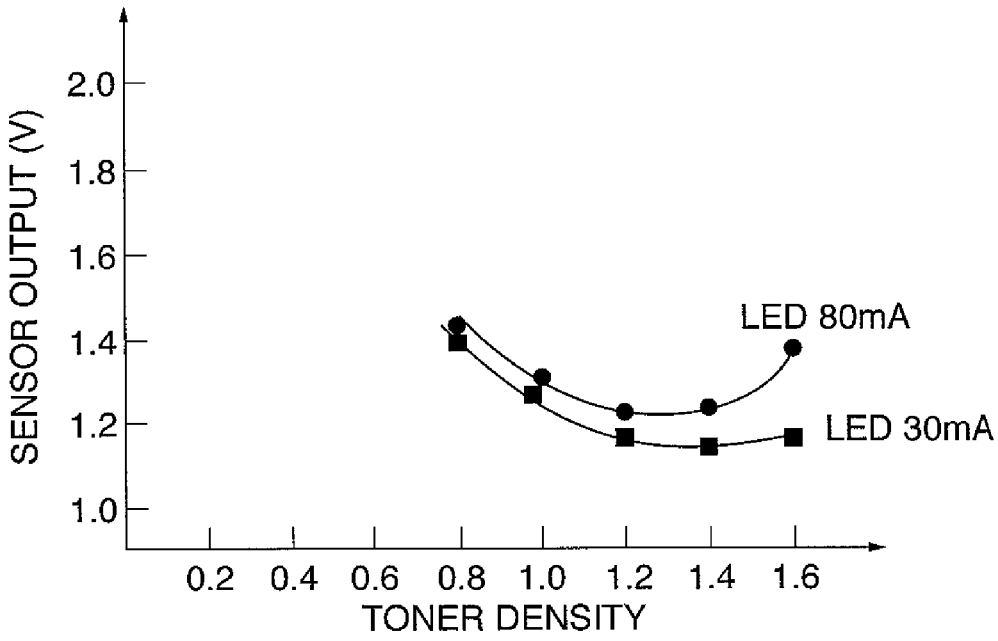
FIG. 13 is a graph showing a relation between the drive current of the pattern detection sensor and the toner pattern density.
Figure 14:
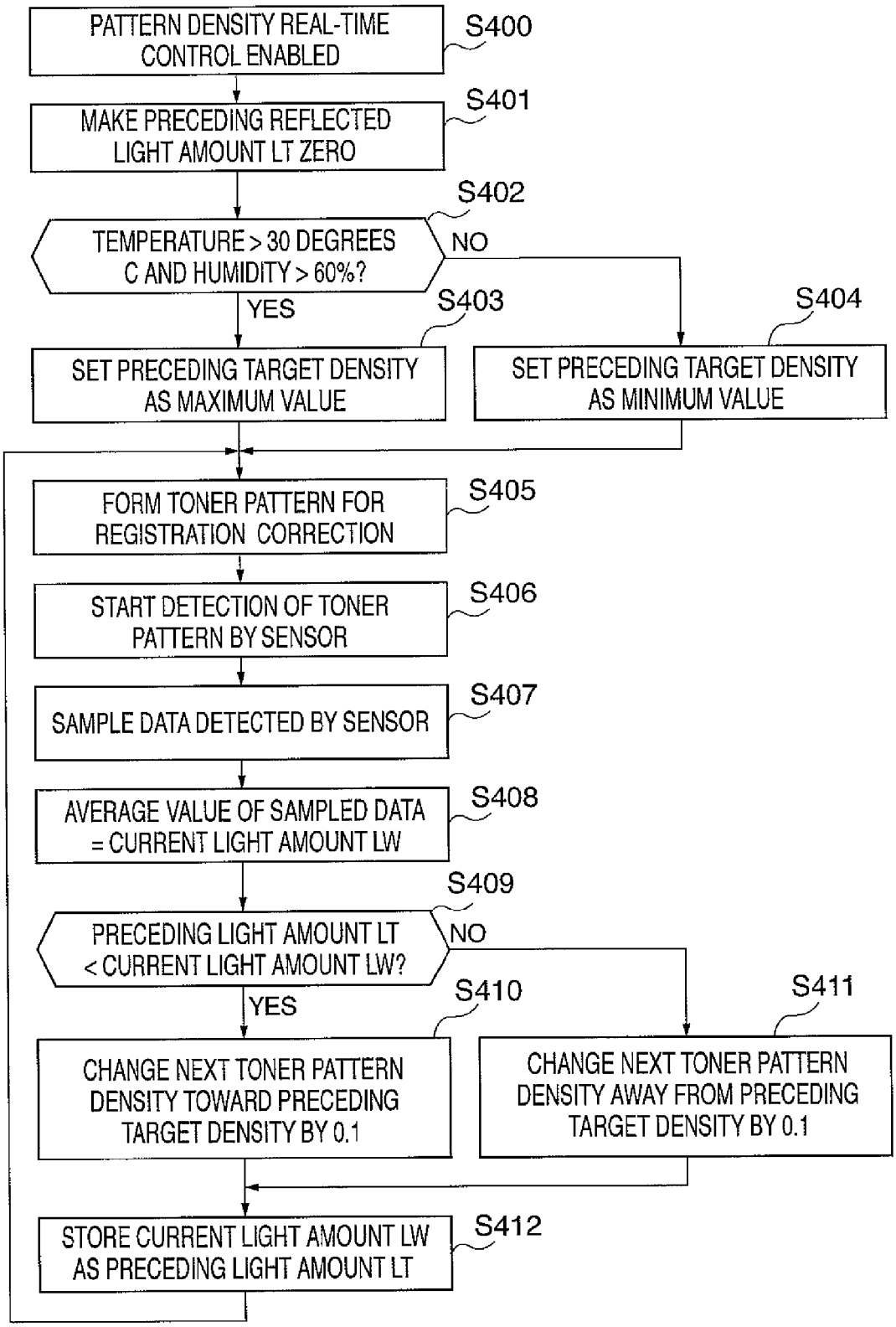
FIG. 14 is a flowchart for explaining an exemplar operation in pattern density real-time control mode II.

FIG. 11 is a block diagram for schematically showing a control circuit of the image forming apparatus of the third embodiment for implementing the registration correction control, and FIG. 12 is a flowchart for explaining an exemplar operation in a pattern density real-time control mode I. FIG. 13 is a graph showing a relation between the drive current of the pattern detection sensor and the toner pattern density, and FIG. 14 is a flowchart for explaining an exemplar operation in a pattern density real-time control mode II. It should be noted that the image forming section of the image forming apparatus is the same as that described with reference to FIG. 1 in the first embodiment, and explanations thereof will be omitted. The basic control for image-position (registration) correction is also the same as that described with reference to FIG. 2 in the first embodiment, and hence explanations thereof will be omitted. The same or similar parts to those shown in the first embodiment are denoted by the same numerals.

First, with reference to FIG. 11, the schematic construction of the control circuit for implementing the image-position (registration) correction control will be described.

The pattern detection sensor (optical detection unit) 7 is a reflective optical sensor for detecting an image-position correction pattern 9 formed on the intermediate transfer belt 5. The pattern detection sensor 7 converts amounts of light reflected by a surface of the intermediate transfer belt 5 and by the image-position correction pattern 9 formed on the belt surface into a voltage for output. The output voltage signal from the pattern detection sensor 7 is supplied to the comparator 102 and the A/D converter 103.

The comparator 102 determines whether or not the output voltage signal from the pattern detection sensor 7 is greater than a predetermined threshold value, and outputs the resultant binarized digital signal to the ASIC 104. The A/D converter 103 converts the analog output voltage signal from the pattern detection sensor 7 into a digital signal for output to the CPU 101.

The ASIC 104, which is comprised of a digital integrated circuit, includes a pattern generator (pattern generating unit) 105, a pattern reading controller 106, a resist shift calculator 107, and a resist timing adjuster 108.

The pattern generator 105 generates image data of the image-position correction pattern 9 for use in registration correction control. The pattern reading controller 106 reads the binarized output signal from the pattern detection sensor 7 and temporarily stores the read pattern data. The resist shift calculator 107 calculates a timing deviation between a sheet and a color toner image 6 based on the pattern data read by the pattern reading controller 106. The resist timing adjuster 108 controls the sheet conveyance timing based on the timing deviation calculated by the resist shift calculator 107.

The CPU 101 forming an essential part of the control system controls various instructions including the timing of execution of the registration correction control. The CPU 101 carries out control based on program data stored in the ROM 111. The program data includes data for use by the light amount adjustment controller 109 for adjusting the amount of light irradiated from the pattern detection sensor 7 in the registration correction control and data for use by a pattern density real-time controller (pattern density control unit) 301 by which the present invention is characterized.

The SRAM 112 is stored with data, which is unique to the apparatus, such as a value of LED drive current of the pattern detection sensor 7 determined by the light amount adjustment controller 109. The image processing controller 202 carries out various image processing control, such as halftone density adjustment, in accordance with instructions supplied from the CPU 101. Furthermore, the apparatus is provided with an environment sensor 203 for detecting temperature and humidity. The output of the sensor 203 is converted into a digital signal by the A/D converter 103 and supplied to the CPU 101.

In the following, an explanation will be given of the pattern density real-time controller 301 by which the present invention is characterized. The pattern density real-time controller 301 is stored with program data for use in controlling alteration of the density of the image-position correction pattern 9 to be formed on the intermediate transfer belt 5 each time the registration correction control is carried out.

More specifically, the pattern density real-time controller 301 is stored with a control program for comparing the amounts of light received by the pattern detection sensor 7 in the preceding toner pattern detection and in the current toner pattern detection. Furthermore, the pattern density real-time controller 301 is stored with a control program for calculating the target density in the next toner pattern formation based on a result of comparison between the amounts of light previously and currently received by the sensor. Moreover, the pattern density real-time controller 301 is stored with a control program to determine whether the target density should be changed toward the strong side or the weak side based on a result of detection by the environment sensor 203, if the data indicating the preceding amount of light received by the sensor has been cleared, such as immediately after power supply is turned on.

Next, with reference to FIG. 12, an explanation will be given of an exemplar operation in the pattern density real-time control mode I.

First, the pattern density real-time control is made enabled (step S300), and a value of zero is written into a memory that stores the preceding reflected light amount LT detected by the pattern detection sensor 7 (step S301).

Next, it is determined whether or not the drive current value of the LED light source of the pattern detection sensor 7 is smaller than 50 mA (step S302). If it is determined that the drive current value of the LED light source is equal to or larger than 50 mA, the target density of the preceding toner pattern formation is set as a minimum value (step S304). On the other hand, if it is determined that the drive current value of the LED light source is smaller than 50 mA, the target density in the preceding toner pattern formation is set as a maximum value (step S303).

In this embodiment, whether or not the drive current value of the LED light source is smaller than the threshold value of 50 mA is determined in the step S302, but this is not limitative. An arbitrary threshold value of drive current can be set according to the apparatus construction or the sensor characteristic.

Then, registration correction control is carried out, whereby a toner pattern is formed on the intermediate transfer belt 5 (step S305), and the toner pattern is detected by the pattern detection sensor 7 (step S306). Digital data obtained by the A/D converter 103 by converting an amount of light reflected from the toner pattern and detected by the pattern detection sensor 7 is sampled by the CPU 101 (step S307). The sampling is carried out on six points on the toner pattern with time intervals. Then, the maximum and minimum sampled data are removed from six pieces of sampled data, and the remaining four pieces of sampled data are averaged (step S308). The average value indicates the amount of reflected light LW in the current toner pattern detection by the pattern detection sensor 7.

Next, a comparison is made between the amount of reflected light LT in the preceding toner pattern detection and that LW in the current detection (step S309). If it is determined that the current amount of reflected light LW is larger than the preceding amount LT, the target density of a toner pattern to be formed on the intermediate transfer belt 5 in the next registration correction control is determined by changing the current target density toward the preceding target density by a value of 0.1 (step S310). On the other hand, if it is determined in the step S309 that the preceding amount of reflected light LT is greater than the current amount LW, then the target density of the toner pattern to be formed on the intermediate transfer belt 5 in the registration correction control is determined by changing the current target density in the direction away from the preceding target density by a value of 0.1 (step S311). Finally, the current amount of reflected light LW is stored as the preceding amount of reflected light LT (step S312), whereupon the process proceeds to the next registration correction control (step S305).

By repeatedly carrying out the above described process, a variation in the amount of light received by the sensor, which is caused by a variation in the toner pattern density, can stably be suppressed to within a permissible range. In the pattern density real-time control mode I, if the present process is carried out for the first time immediately after power supply being turned on or immediately after restoration from a sleep mode, then the data indicating the preceding amount of reflected light LT is cleared, and in the step S302, the data indicating the preceding amount of reflected light is set as a dummy in accordance with the drive current of the LED light source of the pattern detection sensor 7 (irradiated light amount).

The above control is based on the below-described sensor characteristic. When the amount of light irradiated from the LED light source of the pattern detection sensor 7 is small, the amount of light reflected from the toner pattern is also small and hardly affected by a density variation. On the other hand, if the amount of light irradiated from the LED light source of the pattern detection sensor 7 is large, the amount of light reflected by the toner pattern is large and likely to be affected by a density variation.

The just-mentioned relation will be further described with reference to FIG. 13. The pattern detection sensor 7 of this embodiment has the following toner pattern detection characteristic. When the drive current of the LED light source is at a value of 80 mA and the amount of irradiated light is large, the amount of light reflected from the intermediate transfer belt 5 (the base) decreases with increase in toner pattern density in a range where the toner pattern density is smaller than a certain value (near a value of 1.2 in FIG. 13). Thus, with the increase in the toner pattern density, the amount of light received by the pattern detection sensor 7 (sensor output) decreases. However, there is a tendency that, if the toner pattern density further increases, the affection of irregularly reflected light becomes strong and the amount of light received by the pattern detection sensor 7 increases again.

On the other hand, when the drive current value of the LED light source is at a value of 30 mA and the amount of light irradiated from the pattern detection sensor 7 is small, the amount of light reflected from the intermediate transfer belt 5 decreases with increase in toner pattern density in a range where the toner pattern density is smaller than a certain value (near 1.2), as with the case of the drive current having a value of 80 mA. However, in a higher density range in which the toner pattern density has a value of 1.2 or more, the sensor characteristic is such that the amount of light received by the sensor (sensor output) is kept saturated at a lowest point.

With the above sensor characteristic, when the amount of light irradiated from the LED light source of the pattern detection sensor 7 is large, there is the possibility that a large variation occurs in the amount of light received by the sensor, if the toner pattern density is changed in the increasing direction. Conversely, when the amount of light irradiated from the LED light source of the pattern detection sensor 7 is small, the amount of light received by the sensor is stabilized at a small level by changing the toner pattern density in the increasing direction.

Next, with reference to FIG. 14, an exemplar operation in the pattern density real-time control mode II will be described.

First, pattern density real-time control is made enabled (step S400), and a value of zero is written into a memory that stores the preceding amount of reflected light LT of the pattern detection sensor 7 (step S401).

Next, it is determined whether or not a temperature detected by the environment sensor 203 is higher than 30 degrees Celsius and whether or not a humidity detected by the environment sensor 203 is higher than 60% (step S402). If it is determined that the temperature detected by the environment sensor 203 is equal to or lower than 30 degrees Celsius and that the humidity detected by the environment sensor 203 is equal to or lower than 60% (No to the step S402), the process proceeds to a step S404. Otherwise (Yes to the step S402), the process proceeds to a step S403. The step S404 sets as a minimum value the target density at the preceding toner pattern formation, whereas the step S403 sets as a maximum value the target density at the preceding toner pattern formation.

Subsequently, registration correction control is implemented, and a toner pattern is formed on the intermediate transfer belt 5 (step S405) and detected by the pattern detection sensor 7 (step S406). Digital data, into which an amount of light reflected from the toner pattern and detected by the pattern detection sensor 7 is converted by the A/D converter 103, is sampled by the CPU 101 (step S407). The sampling is carried out on six points on the toner pattern with time intervals. Then, the maximum and minimum sampled data are removed from six pieces of sampled data, and the remaining four pieces of sampled data are averaged (step S408). The average value indicates the amount of reflected light LW in the current toner pattern detection by the pattern detection sensor 7.

Next, a comparison is made between the amount of reflected light LT in the preceding toner pattern detection and the amount of reflected light LW in the current detection (step S409). If it is determined that the current amount of reflected light LW is larger than the preceding amount LT, the target density of a toner pattern to be formed on the intermediate transfer belt 5 in the next registration correction control is determined by changing the current target density toward the preceding target density by a value of 0.1 (step S410). On the other hand, if it is determined in the step S409 that the preceding amount of reflected light LT is greater than the current amount LW, then the target density of the toner pattern to be formed on the intermediate transfer belt 5 in the registration correction control is determined by changing the current target density in the direction away from the preceding target density by a value of 0.1 (step S411). Finally, the current amount of reflected light LW is stored as the preceding amount of reflected light LT (step S412), whereupon the process proceeds to the next registration correction control (step S405).

As compared to the pattern density real-time control mode I previously described, the pattern density real-time control mode II is different only in that data indicating the preceding amount of reflected light is set as a dummy in accordance with the environmental condition (i.e., temperature and humidity) detected in the step S402. The step S402 determines whether or not the circumstance where the apparatus is disposed is a high temperature and humidity environment from a result of detection by the environment sensor 203. If it is determined that the apparatus is disposed in a high temperature and humidity environment (the detected temperature is higher than 30 degrees Celsius and the detected humidity is higher than 60%), then the process proceeds to the step S403 in which the preceding target density is set as a maximum value.

This is because the image forming apparatus of this embodiment has such a characteristic that the toner pattern density tends to decrease in a high temperature and humidity environment. It is not always true that all the types of apparatuses have such characteristic, and the toner pattern density characteristic varies according to the apparatus construction and toner material. Therefore, the environment condition to be determined in the step S402 can be set arbitrarily.

If the apparatus having the above described characteristic is moved to a high temperature and humidity environment, the toner density is changed to decrease at the first toner pattern formation immediately after power supply is turned on. In that case, toner pattern density alteration control can immediately be stabilized by changing the next toner pattern toward the denser side.

As described above, this embodiment changes the target density of the toner pattern to be formed on the intermediate transfer belt 5 in the next registration correction control based on the received light amount in the toner pattern detection by the pattern detection sensor 7.

Even if the toner density varies due to environmental variation or long-term use of the apparatus, it is possible to stabilize the amount of light received by the pattern detection sensor 7 in the toner pattern detection to the desired level, whereby the toner pattern density can be optimized in real-time.

As a result, a sufficient difference between amounts of light reflected by the intermediate transfer belt 5 forming the base and by the image-position correction pattern 9 can be ensured with stability, thereby preventing a failure in detecting the image-position correction pattern 9 from occurring and preventing an image with image position deviation from being printed out.

It should be noted that the present invention is not limitative to the above described embodiments but may be modified in a scope not departing from the gist of this invention.

For example, the case has been described in the embodiments in which the pattern detection sensor 7 detects one or more toner patterns formed on the intermediate transfer belt 5, but this invention is not limited thereto. Specifically, this invention is also applicable to a case where the pattern detection sensor 7 detects one or more toner patterns formed on photosensitive drums (image carriers) 1*a* to 1*d* or a sheet (transfer material).

It is to be understood that the present invention may also be accomplished by supplying a system or an apparatus with a storage medium in which a program code of software, which realizes the functions of the above described embodiments is stored and by causing a computer (or CPU or MPU) of the system or apparatus to read out and execute the program code stored in the storage medium.

In that case, the program code itself read from the storage medium realizes the functions of the above described embodiments, and therefore, the program code and the storage medium in which the program code is stored constitute the present invention.

Examples of the storage medium for supplying the program code include a floppy (registered trademark) disk, a hard disk, and a magnetic-optical disk, an optical disk such as a CD-ROM, a CD-R, a CD-RW, a DVD-ROM, a DVD-RAM, a DVD-RW, a DVD+RW, a magnetic tape, a nonvolatile memory card, and a ROM. The program code may be downloaded via a network.

Further, it is to be understood that the functions of the above described embodiments may be accomplished not only by executing the program code read out by a computer, but also by causing an OS (operating system) or the like which operates on the computer to perform a part or all of the actual operations based on instructions of the program code.

Further, it is to be understood that the functions of the above described embodiments may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-278850, filed Oct. 12, 2006, which is hereby incorporated by reference herein in its entirety.

What is claimed is:

1. An image forming apparatus comprising:

an image forming unit configured to form a toner pattern having a first density on an image carrier;

a detection unit configured to irradiate light onto the image carrier and the toner pattern, receive light reflected from the image carrier and the toner pattern, and detect a position of the toner pattern on the image carrier based on the received reflected light, the reflected light including regular reflected light from the image carrier and the toner pattern; and a density control unit configured to, in a case where an amount of the reflected light from the toner pattern received by the detection unit is less than a predetermined amount, which corresponds to an amount of reflected light from a toner pattern having a second density, which is different from the first density, on the image carrier, control the image forming unit to also form a next toner pattern having the first density on the image carrier, wherein the image forming unit comprises a plurality of image forming sections configured to form a plurality of toner images of different colors on the image carrier, respectively, and each of the plurality of image forming sections forms the toner pattern to detect relative positions of the plurality of toner images formed on the image carrier, and wherein the density control unit controls the density of the toner pattern for each color, individually.

2. The image forming apparatus according to claim 1, wherein the density control unit controls the image forming unit to form the next toner pattern having the second density so that a difference between the amount of light reflected from the image carrier received by the detection unit and the amount of light reflected from the toner pattern received by the detection unit is at a maximum.

3. The image forming apparatus according to claim 1, wherein the image forming unit:

forms a toner image on the image carrier, comprises a transfer unit configured to transfer the toner image formed on the image carrier onto a recording medium, and a conveying unit configured to convey the recording medium to a transfer portion, controls the image forming unit to form the toner pattern before forming the toner image to be transferred to a single recording medium, and comprises a conveyance control unit configured to control a position of the toner image transferred to the single recording medium by controlling a timing of conveyance of the single recording medium conveyed to the transfer portion by the conveying unit as a result of the detection unit detecting the toner pattern.

4. The image forming apparatus according to claim 1, wherein the density control unit controls the density of the toner pattern each time a predetermined number of recording mediums each has been printed with the toner image.

5. The image forming apparatus according to claim 1, wherein the first density is less than the second density.

6. The image forming apparatus according to claim 1, wherein the density control unit controls the image forming unit to form the toner pattern to comprise a plurality of gradation toner patterns having a plurality of gradating densities, and controls the density of the next toner pattern based on a result of the detection of the gradation toner patterns by the detection unit.

7. The image forming apparatus according to claim 6, wherein an amount of light irradiated on the gradation toner patterns is at a maximum irradiation amount of light.

8. The image forming apparatus according to claim 6, wherein an amount of light irradiated on the gradation toner patterns and an amount of light irradiated on the image carrier are identical to each other.

9. The image forming apparatus according to claim 1, wherein the density control unit controls the density of the toner pattern after a predetermined image processing mode has been changed.

10. The image forming apparatus according to claim 1, wherein the density control unit controls the density of the toner pattern each time a predetermined time period elapses after power supply is turned on.

11. The image forming apparatus according to claim 1, further comprising:

an environment detection unit configured to detect at least one of temperature or humidity, wherein the density control unit determines when the density of the toner pattern is controlled based on a result of the detection of the environment detection unit.

12. An image forming apparatus comprising:

an image forming unit configured to form a toner pattern on an image carrier;

a detection unit configured to irradiate light onto the image carrier and the toner pattern including a position detecting pattern and a light amount detecting pattern, the light amount detecting pattern including a first pattern and a second pattern having a density different from a density of the first pattern, receive light reflected from the image carrier and the toner pattern, detect a position of the position detecting pattern on the image carrier based on the received reflected light, the reflected light including regular reflected light from the image carrier and the position detecting pattern and detect a light amount of reflected light from the light amount detecting pattern; and a density control unit configured to, in a case where an amount of the reflected light from the first pattern is less than an amount of the regular reflected light from the second pattern, control the image forming unit to form the position detecting pattern at the density of the first pattern, wherein the image forming unit comprises a plurality of image forming sections configured to form a plurality of toner images of different colors on the image carrier, and each of the plurality of image forming sections forms the position detecting pattern to detect relative positions of the plurality of toner images formed on the image carrier, and wherein the density control unit controls the density of the position detecting pattern for each color.

13. The image forming apparatus according to claim 12, wherein the density of the first pattern is less than the density of the second pattern.

14. The image forming apparatus according to claim 12, wherein:

the light amount detecting pattern includes a plurality of patterns including the first pattern and the second pattern, and the density of the plurality of patterns is different from each other, and the density control unit controls the image forming unit to form the light amount detecting pattern, and controls the density of the position detecting pattern based on a result of the detection of the light amount detecting patterns by the detection unit.

15. The image forming apparatus according to claim 14, wherein an amount of light irradiated on the plurality of patterns including the first pattern and the second pattern is at a maximum irradiation amount of light.

16. The image forming apparatus according to claim 14, wherein an amount of light irradiated on the plurality of patterns including the first pattern and the second pattern and an amount of light irradiated on the image carrier are identical to each other.

17. The image forming apparatus according to claim 14, wherein the density control unit controls the image forming unit to form the position detecting pattern at the density of the first pattern from which the amount of the reflected light detected by the detection unit is a minimum among the light amounts from the reflected light from each of the plurality of patterns detected by the detection unit.

18. The image forming apparatus according to claim 12, wherein the density control unit controls the density of the toner pattern after a predetermined image processing mode has been changed.

19. The image forming apparatus according to claim 12, wherein the density control unit controls the density of the toner pattern each time a predetermined time period elapses after power supply is turned on.

20. The image forming apparatus according to claim 12, further comprising:

an environment detection unit configured to detect at least one of temperature or humidity, wherein the density control unit determines when the density of the toner pattern is controlled based on a result of the detection of the environment detection unit.

* * * * *